US006634197B2

(12) United States Patent
Widen et al.

(10) Patent No.: US 6,634,197 B2
(45) Date of Patent: Oct. 21, 2003

(54) LOCK DEVICE WITH REMOVABLE CORE

(75) Inventors: Johan Widen, Eskilstuna (SE); Mikael Nylander, Eskilstuna (SE)

(73) Assignee: Assa AB, Eskilstuna (SE)

( * ) Notice: Subject to any disclaimer, the term of this patent is extended or adjusted under 35 U.S.C. 154(b) by 0 days.

(21) Appl. No.: 10/050,946

(22) Filed: Jan. 22, 2002

(65) Prior Publication Data

US 2003/0136164 A1 Jul. 24, 2003

(51) Int. Cl.[7] ..... E05B 27/06

(52) U.S. Cl. ..... 70/369; 70/337; 70/371; 70/379 R; 70/380; 70/495

(58) Field of Search ..... 70/367–371, 337–343, 70/495, 496, 379 R, 379 A, 380, 382, 385

(56) References Cited

U.S. PATENT DOCUMENTS

| | | | | | |
|---|---|---|---|---|---|
| 1,141,463 | A | * | 6/1915 | Hurd | |
| 1,964,787 | A | * | 7/1934 | Voight | |
| 2,036,764 | A | * | 4/1936 | Lowe | |
| 2,079,583 | A | * | 5/1937 | Brauning | |
| 3,410,123 | A | * | 11/1968 | Jacobi | |
| 5,209,087 | A | * | 5/1993 | Cox | 70/369 |
| 5,375,444 | A | * | 12/1994 | Smith | 70/495 |
| 5,431,034 | A | * | 7/1995 | Fann et al. | 70/369 |
| 5,640,864 | A | * | 6/1997 | Miyamoto | 70/379 R |
| 6,012,311 | A | * | 1/2000 | Duckwall | 70/369 |

FOREIGN PATENT DOCUMENTS

| | | | | |
|---|---|---|---|---|
| DE | 954761 | * | 12/1956 | 70/493 |
| DE | 1022492 | * | 1/1958 | 70/493 |
| DE | 1028460 | * | 4/1958 | 70/493 |
| DE | 4008649 | * | 9/1991 | 70/367 |
| JP | 404182582 | * | 6/1992 | 70/495 |

* cited by examiner

*Primary Examiner*—Lloyd A. Gall
(74) *Attorney, Agent, or Firm*—Sughrue Mion, PLLC

(57) ABSTRACT

A removable core lock and key device comprises a cylinder housing (10) and a core (20), which is accommodated in the cylinder housing. An adapter (30) is operatively connected to a bolt (32). The core and the adapter are provided with a connection (**20*d*, 30*d*), such as a bayonet joint, that selectively prevents withdrawal of the core from the housing. Key actuated engagement elements (28, 30*c***) are arranged to selectively allow mutual rotation of the adapter and the core so as to disengage the connection, thereby allowing withdrawal of the core. A simple yet reliable removable core is thereby provided.

7 Claims, 5 Drawing Sheets

LOCK DEVICE WITH REMOVABLE CORE

FIELD OF INVENTION

The present invention relates generally to lock devices and, more particularly, to a lock assembly with a key-activated removable core structure.

BACKGROUND

A cylinder lock comprises a central plug or core and an outer shell or housing, in which the core rotates. The housing is mounted in a suitable latch structure. A number of prior art disclosures describe devices intended to provide a removable core in a cylinder lock. The advantage of removable core locks is that they may be rapidly re-keyed by relatively unskilled personnel. Such re-keying may be required as a result of a potential security breach or occurring due to the loss or non-return of a key.

The patent publication U.S. Pat. No. 6,076,386 (Etchells et. al.) describes a removable core lock wherein a restraining member in the form of a ball is provided in a concentric groove formed onto a core housing. A drawback with that solution is the lack of code related blocking mechanism for the removal of the core.

A removable core lock for cars is disclosed in the patent publication U.S. Pat. No. 2,036,764, wherein the connection between the core and an adapter actuating the lock operating means is in the form of a bayonet joint releasable without tools. In order to operate the lock, a long user key engaging a groove in the adapter must be used to rotate not only the core but also the adapter. In order to disengage the core from the adapter, a short key is used, whereby the core is rotated 90 degrees relatively to the adapter in a specified direction.

While this latter solution provides for a simple design, it is accompanied by several drawbacks. Firstly, the rotation of the adapter relies on the strength of the key tip, resulting in an unreliable operation. Secondly, this lock is relatively easy to manipulate.

SUMMARY OF THE INVENTION

An object of the present invention is to provide a removable core lock wherein the drawbacks of prior art devices are eliminated or at least mitigated.

The invention is based on the realization that engagement elements can be used to selectively engage and disengage the rotation of a core relatively to an adapter in a removable core lock.

According to the invention there is provided a removable core lock and key and a service key as recited in the claims.

With the inventive device the above-mentioned drawbacks of prior art are eliminated or at least mitigated. The lock device according to the present invention as defined by the appended claims has a configuration wherein means of connection are provided to axially interlock the core and an adapter operatively connected to a bolt, nd wherein engagement elements are provided to allow or prevent the means of connection to be disengaged.

In a particularly preferred embodiment, the engagement elements comprise a radially moveable side bar in the core and a recess in an aperture in an adapter operatively connected to a bolt. The side bar provides a secure way of preventing rotation of the core relatively to the adapter. In a further preferred embodiment, a bayonet joint is used as the means of connection to prevent withdrawal of the core from the cylinder housing, providing a robust arrangement.

Further preferred features are defined in the dependent claims.

BRIEF DESCRIPTION OF DRAWINGS

The invention is now described, by way of example, with reference to the accompanying drawings, in which.

DETAILED DESCRIPTION OF THE INVENTION

Figure 1:
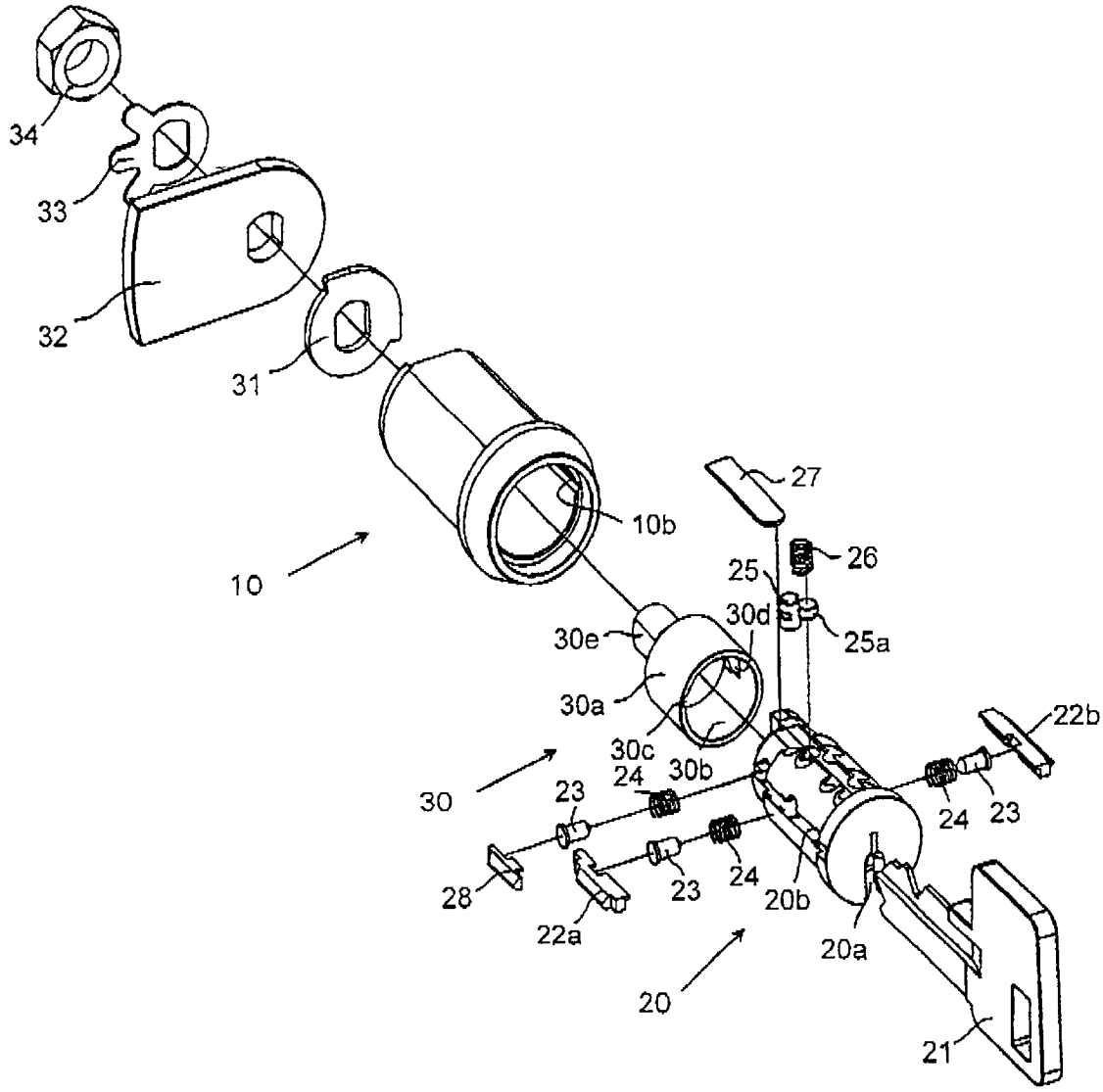
FIG. 1 is an overall exploded view of a lock device according to the invention.

In the following a detailed description of a preferred embodiment of the present invention will be given. In FIG. 1 there is shown an exploded view showing the parts comprised in a lock device according to the invention. A cylinder housing 10 is provided with a substantially circular cavity arranged to accommodate a substantially circular cylinder core, generally designated 20. The core has a key way 20*a* arranged to receive a key 21, as is conventional. Two outer side bars 22*a*, 22*b* are arranged in a respective longitudinal groove 20*b* in the core, one of which is visible in FIG. 1. Push pins 23 and springs 24 are provided for biasing the side bars radially outwardly and into engagement with a respective longitudinal groove 10*b* in the inner surface of the substantially circular cavity of cylinder housing 10. One of such grooves 10*b* is visible in FIG. 1. A side bar arrangement of the above kind is described for example in the international patent publication WO 93/12314 (H äggström), which is incorporated herein by reference.

Figure 5:
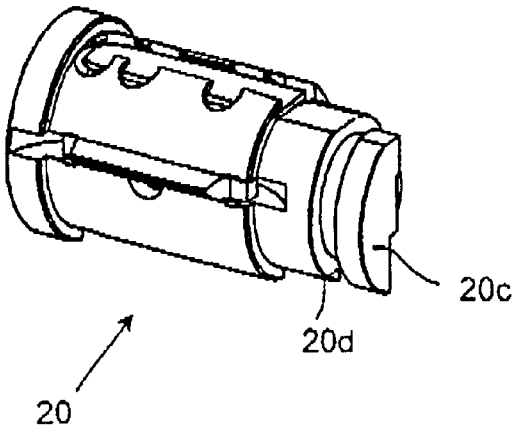
FIG. 5 is a detailed view of the core in FIGS. 2 and 3.
Figure 6:
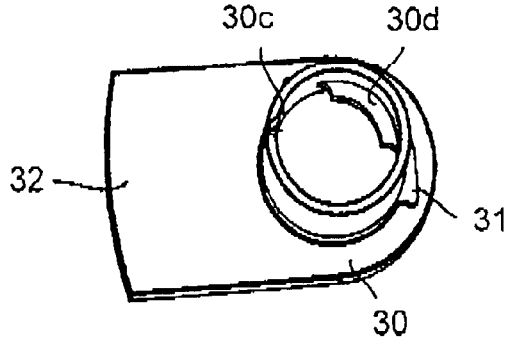
FIG. 6 is a detailed view of an adapter part with attached bolt.

At the inner end thereof, the core 20 is provided with a semi-circular extension 20*c* having a groove 20*d* formed therein, see FIG. 5. The function of this protruding portion will be explained below with reference to FIGS. 5 and 6.

Returning to FIG. 1, a blocking pin 25 is provided in an opening in the core 20. The blocking pin is spring biased downwardly by means of a spring 26 acting on an essentially disc-shaped portion 25*a* of the blocking pin. The spring 26 is kept in position by a cover plate 27. The blocking pin 25 is moveable between a first position, wherein it blocks the radial movement of a further or inner side bar 28, and a second position, wherein the radial movement of the inner side bar is not blocked. The inner side bar functions to prevent mutual rotational movement of the core 20 and an adapter 30, as will be described in detail below with reference to FIGS. 10*a–c*.

The adapter 30 is substantially circular with an outer surface 30*a* with diameter corresponding to that of the main portion of the core 20. The adapter 30 has an aperture with a substantially circular inner surface 30*b* with a longitudinal groove 30*c* arranged to receive the inner side bar 28 of the core. There is also a concentric flange 30*d* covering about 90 degrees of the inner circumference of the adapter, see FIG. 6.

The adapter ends in a tailpiece 30*e* arranged to be operatively connected to a stop washer 31, a bolt 32, a lock washer 33, and a nut 34. The bolt 32 is kept in place on the tailpiece by means of the nut 34 and thus rotates with the adapter, thereby being operatively connected to the locking mechanism of the lock. The adapter is thus rotatably arranged within the substantially circular cavity of cylinder housing 10 and inside of the core 20.

Figure 2:
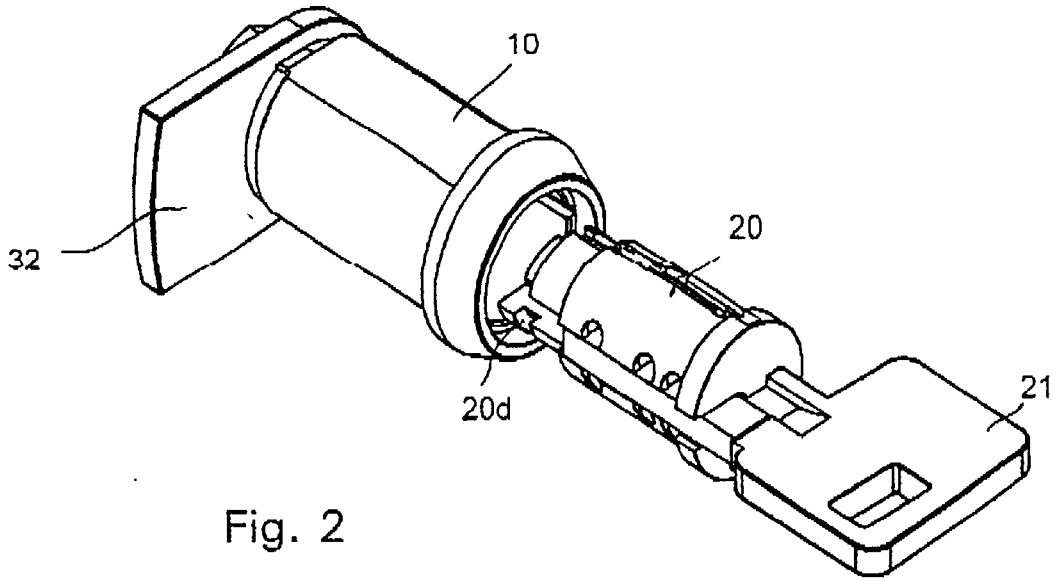
FIGS. 2 and 3 are perspective views of the lock device in FIG. 1 with a core removed from a cylinder housing.
Figure 3:
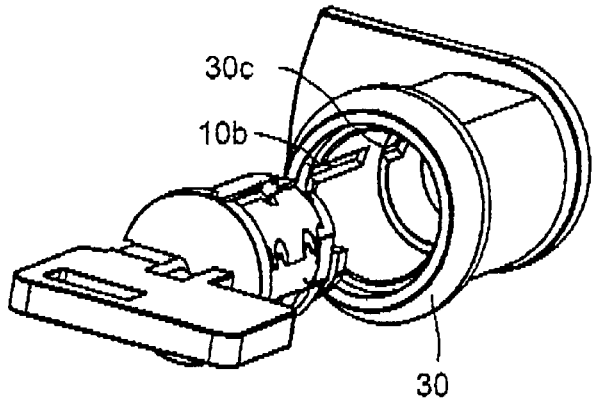

In FIGS. 2 and 3 there is shown how the removable core 20 with an inserted key 21 is positioned in relation to the cylinder housing 10 during insertion or retraction of the core. From FIG. 3 there is seen that the longitudinal groove 10*b* of the housing 10 is aligned with the longitudinal groove 30*c* of the adapter 30. This is to allow the outer side bar 22*a* to engage the groove 10*b* in the housing while the inner side bar 28 engages the groove 30*c* in the adapter.

Figure 4:
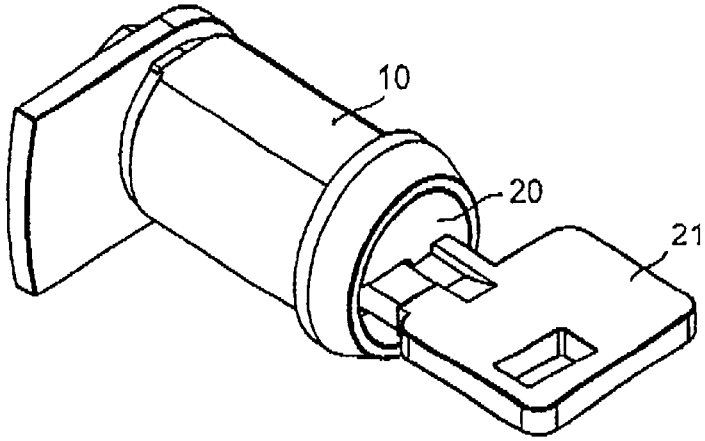
FIG. 4 is a perspective view of the lock device with inserted core.

In FIG. 4 the assembled lock device is shown.

In FIG. 5 the semi-circular extension 20*c* of the core 20 is shown with the groove 20*d* formed therein. The groove 20*d* is arranged to co-operate with the flange 30*d* of the adapter 30, which covers approximately 90 degrees of the inner surface of the adapter. When the core 20 is inserted into the housing and the extension thereof engages the adapter 30, the core has a rotational position so that the extension 20*c* avoids the flange 30*d*. Subsequently, when the core is turned about 90 degrees in the housing, the flange 30*d* engages the groove 20*d* in the extension so as to provide a bayonet joint between the core and the adapter, thereby blocking longitudinal or axial movement of the core. Withdrawal of the core from the housing is thereby prevented. In that rotational position, the side bars 22, 28 are aligned with a respective longitudinal groove 10*b*, 30*c* in the housing and the adapter, respectively, and engage therein.

Figure 7:
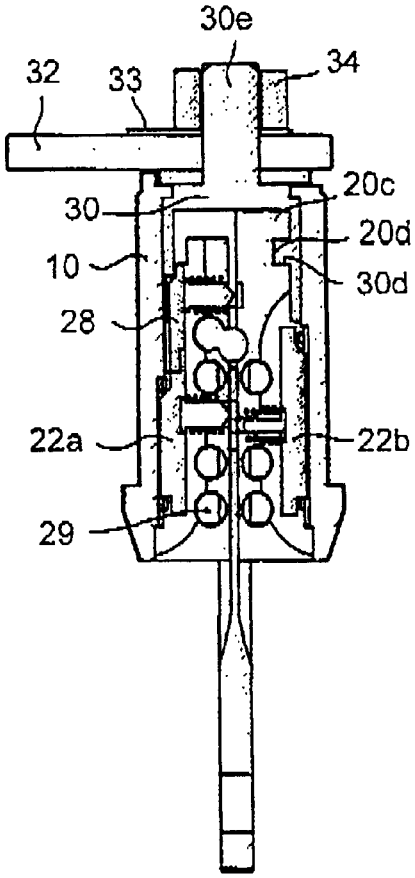
FIG. 7 is a top sectional view of the lock device.

The rotational blocking of the adapter relatively to the core will now be explained in detail, mainly with reference to FIG. 7, which is a top sectional view of the lock device. It is there seen how the outer side bars 22*a*, 22*b* are pushed into engagement with the respective groove in the housing. When the key 21 is withdrawn, the outer side bars 22*a*, 22*b* are blocked from moving radially inwardly and leaving the grooves in the housing due to the pin tumblers 29, thereby preventing rotation of the core in the housing when the key is removed, as is conventional. For a complete description of the operation thereof, see the above referenced publication.

The inner side bar 28, being pushed into engagement with the groove in the adapter, prevents mutual rotation of the core 20 and the adapter 30. The co-operation of the groove 20*d* in the core extension and the flange 30*d* prevents longitudinal movement of the core, thereby keeping it completely fixed in the housing.

The movement of the inner side bar 28 is controlled in a different way, as will be explained in detail below with reference to FIGS. 10*a–c* and 11*a–c*. However, the difference between a user key, shown in FIG. 8, and a service key, shown in FIG. 9, will first be explained.

Figure 8:
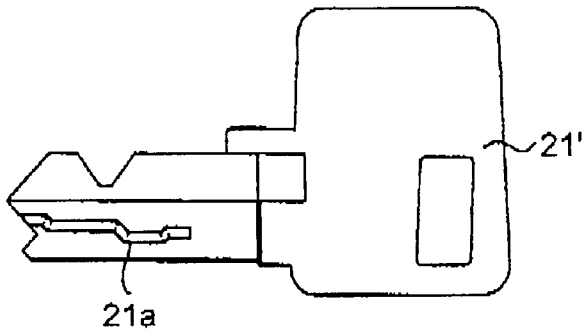
FIGS. 8 and 9 are side views of a user key and a service key, respectively, for use with the lock device.
Figure 9:
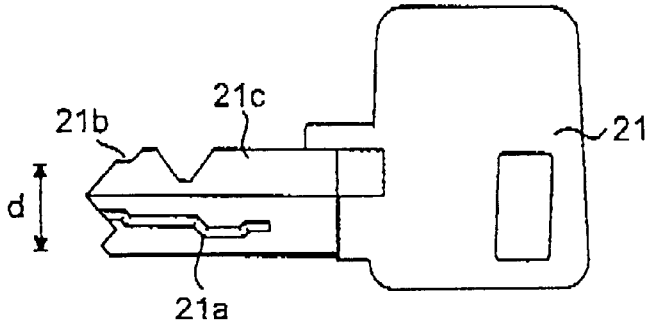

In FIG. 8 there is shown a user key 21' with a groove 21*a* arranged in a side surface of a key bit portion 21*c* and controlling the movement of the pin tumblers 29, as is conventional. The service key 21 shown in FIG. 9 differs from the user key only in that there is provided a notch or indent 21*b* in the upper end portion of the key bit having an essentially planar surface. The notch can have different heights or codes, denoted by the distance "d" in the figure, which is the height from the bottom of the key bit to the planar surface of the notch. In a preferred embodiment, "d" can take three different values, thus providing three different service key codes.

Figure 10A:
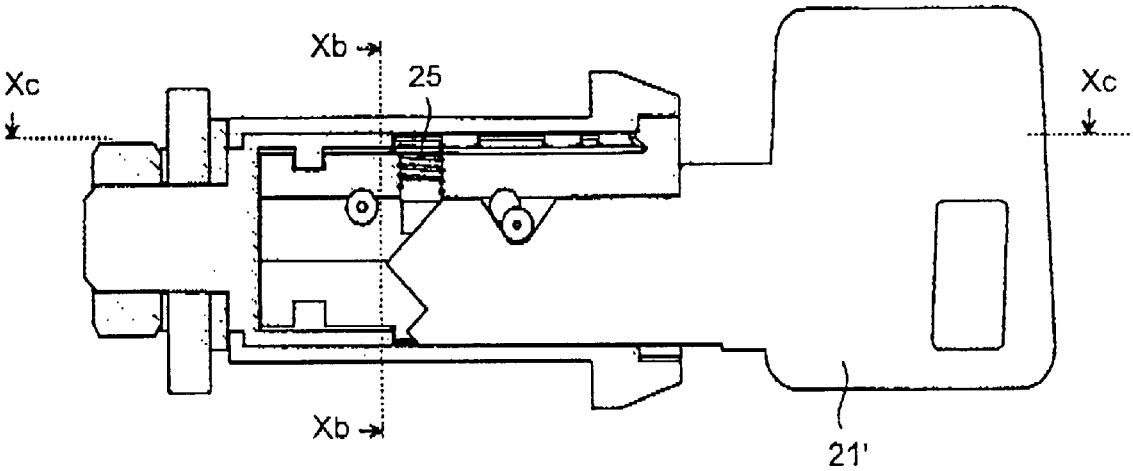
FIG. 10*a* is an elevation sectional view of the lock device with inserted user key.
Figure 10B:
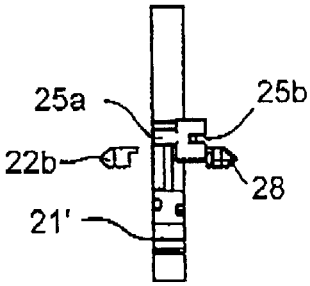
FIGS. 10*b* and 10*c* are views taken along the lines Xb—Xb and Xc—Xc, respectively, showing an inserted user key co-operating with a blocking pin.
Figure 10C:
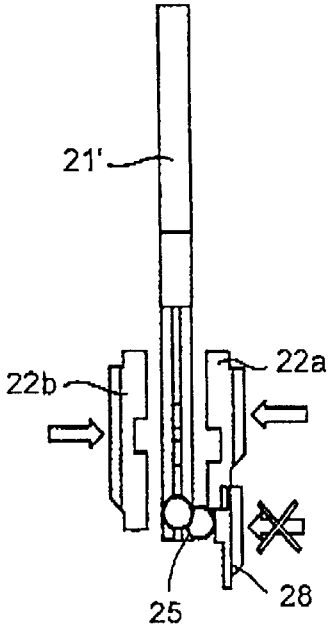

With no key in the cylinder 20, the blocking pin 25 is pushed downwardly by the spring 26, see FIG. 1, to a lower end position. In FIG. 10*a*, which is a sectional view of the lock device with an inserted user key 21', there is seen how the upper forward slanting portion of the key has pushed the blocking pin 25 upwardly to a defined level. This is also shown in FIG. 10*b*, which is an end view taken along the line Xb—Xb of FIG. 10*a* and showing only the key 21', the blocking pin 25, the inner side bar 28, and the outer side bar 22*b*. It is here seen that the key acts on the essentially disc-shaped portion of the blocking pin, see also FIG. 10*c*. In this position, a groove 25*b* in the blocking pin 25 is at a different level than the inner side bar 28. The inner side bar is thus prevented from moving inwardly by the blocking pin, as is indicated by the crossed-over arrow in FIG. 10*c*. However, because the user key has correct code in the form of the side groove 21*a*, see FIG. 8, the outer side bars 22*a*, 22*b* are allowed to move inwardly, as indicated by the other arrow in FIG. 10*c*. When the user key is turned, the core following the turning of the key can rotate relatively to the housing. Due to the inner side bar 28, the core 20 and the adapter 30 are not allowed to rotate relatively to each other. In other words, when the user key is turned, the adapter rotates with the core, bringing the bolt 32 attached to the tailpiece 30*e* with it. All the time, the bayonet joint provided by the core extension 20*c* and the flange 30*d* prevents withdrawal of the core from the housing.

Figure 11A:
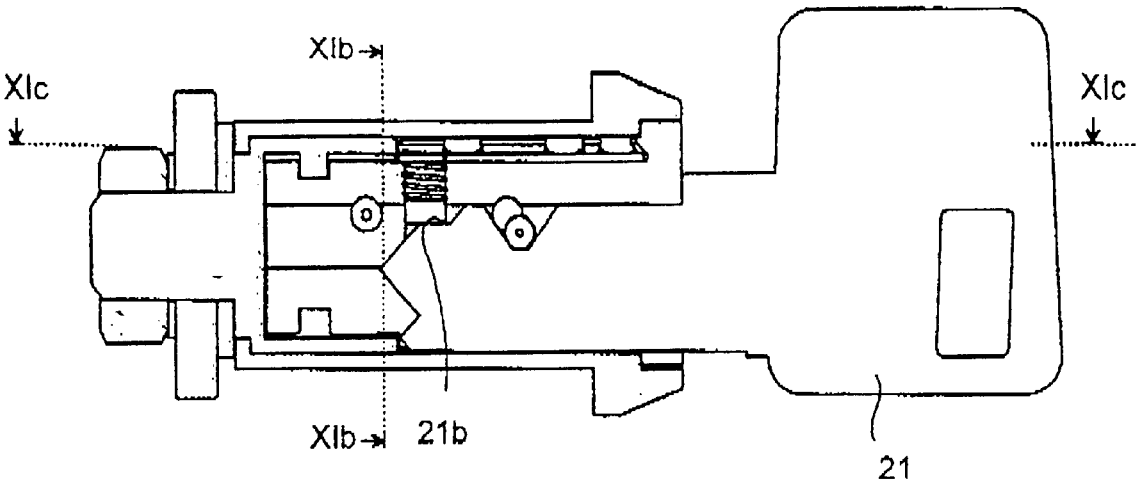
FIGS. 11*a–c* are views similar to FIGS. 10*a–c* but showing the use of a service key instead of a user key.
Figure 11B:
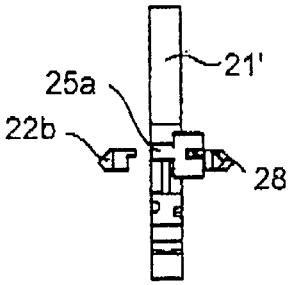
Figure 11C:
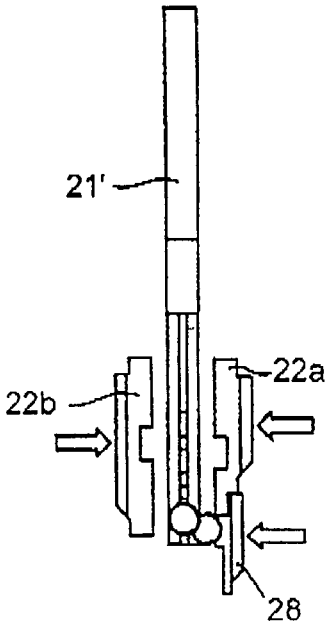

In FIG. 11*a* there is shown how a service key 21 having an indent 21*b* has pushed the blocking pin 25 to a different level than the user key in FIG. 10*a*. In FIG. 11*b* there is seen how the inner side bar 28 engages the groove in the blocking pin 25. The inner side bar 28 is thereby allowed to move inwardly from engagement with the longitudinal groove 30*c* in the adapter 30.

When the core 20 has been turned or rotated approximately 90 degrees, the flange 30*d* of the adapter disengages from the groove 20*d* in the core, whereby the core is free to be withdrawn from the housing cavity 10*a*. A key operated removable core is thus provided.

In the figures there is also seen that part of the outer side bar 22*a* blocks inward movement of the inner side bar 28 when the outer side bar is engaging the groove in the core. This means that a service key 21 pushing the blocking pin 25 to a correct level for allowing the inner side bar to enter the groove in the blocking pin but having the wrong side code 21*a* will block inward movement of the outer side bar 22*a*, which in turn blocks inward movement of the inner side bar 28. In order to remove the core 20 from the lock a service key is required which is provided with both correct code for the outer side bar and correct service key code for the inner side bar.

Several advantages are obtained with the described lock device. Firstly, a simple yet reliable solution is provided. Because a side bar or the like is used as means for bringing the adapter to rotate, a robust connection between core and adapter is obtained. Secondly, because the same adapter can be used for locks adapted for both left-handed and right-handed doors, the number of different parts needed is decreased. You only have to change the position of the stop washer 31.

A preferred embodiment of a lock device according to the invention has been described. A person skilled in the art realizes that this could be varied within the scope of the appended claims. Thus, although a lock having two outer side bars have been shown, the inventive idea is also applicable to locks having only one outer side bar or no side bars at all for the locking of the cylinder in the cylinder housing. Instead, a lock having conventional pin tumblers comprising top and bottom pins can be used with the invention.

An inner side bar has been described as the engagement element engaging an engagement element in the form of a groove in the adapter. However, the engagement elements can take many different shapes.

What is claimed is:

1. A removable core lock and key device comprising:

a cylinder housing;

a substantially cylindrical cylinder core which is accommodated in said cylinder housing and has a key slot for reception of a key;

an adapter operatively connected to a bolt, wherein said core and said adapter are provided with means of connection between said core and said adapter permitting relative rotational movement between said core and said adapter between a first position, wherein relative axial movement between said core and said adapter is prevented, and a second position, wherein relative axial movement between said core and said adapter is permitted;

a first engagement element provided with said core;

a blocking element preventing movement of said first engagement element when a user key is inserted in said key slot and permitting movement of said first engagement element when a service key is inserted in said key slot; and a second engagement element provided in said adapter, wherein, in said first relative position of said core and said adapter, with no service key inserted, said first and second engagement elements are arranged to co-operate, whereby said adapter rotates with said core, and said first engagement element comprises a radially moveable side bar in said core and said second engagement element comprises a recess in an aperture in said adapter.

2. The device according to claim 1, wherein said blocking element comprises a pin moveable between blocking positions and a non-blocking position, and wherein, during insertion of a service key into said key slot, a code portion of said service key moves said blocking element to said non-blocking position.

3. The device according to claim 2, wherein said blocking element is spring biased towards a blocking position.

4. The device according to claim 2, wherein said pin comprises a groove arranged, in said non-blocking position of said pin, to receive part of said side bar.

5. The device according to claim 1, wherein said cylinder core comprises a further side bar arranged to engage an inner groove in said cylinder housing, and wherein said further side bar, during engagement of said inner groove, blocks radially inward movement of said side bar.

6. The device according to claim 1, wherein said core comprises an extension arranged to fit into an aperture in said adapter.

7. The device according to claim 6, wherein said means of connection comprises a groove arranged in said extension and a flange arranged in said aperture in said adapter so as to form a bayonet joint.

* * * * *